United States Patent [19]

Hiramatsu

[11] 4,173,207

[45] Nov. 6, 1979

[54] CANISTER

[75] Inventor: Eiji Hiramatsu, Aichi, Japan

[73] Assignee: Toyota Jidosha Kogyo Kabushiki Kaisha, Toyota, Japan

[21] Appl. No.: 889,112

[22] Filed: Mar. 22, 1978

Related U.S. Application Data

[63] Continuation of Ser. No. 697,848, Jun. 21, 1976, abandoned.

[30] Foreign Application Priority Data

Jan. 14, 1976 [JP] Japan ..... 51-2784

[51] Int. Cl.[2] ..... F02M 37/02

[52] U.S. Cl. ..... 123/136

[58] Field of Search ..... 123/136; 220/85 VR, 220/85 VS; 55/387, DIG. 28

[56] References Cited

U.S. PATENT DOCUMENTS

| | | | |
|---|---|---|---|
| 3,352,294 | 11/1967 | Biller et al. | 123/136 |
| 3,628,517 | 12/1971 | Soberski | 123/136 |
| 3,683,597 | 8/1972 | Beveridge et al. | 123/136 X |
| 3,730,158 | 5/1973 | St. Amand | 123/136 |

*Primary Examiner*—Charles J. Myhre
*Assistant Examiner*—Tony M. Argenbright

[57] ABSTRACT

A canister comprising:

a main body having a space therein; an adsorbent material contained in the space of said main body; an inlet pipe attached to said main body for connecting a carburetor float chamber with an upper portion of said space defined between said main body and said adsorbent material; an air suction pipe attached to said main body through which pipe the lower portion of said space defined between said canister and said adsorbent material communicates with the atmosphere; and valve means for selectively connecting said upper portion of said space with a fuel tank, thereby to prevent an evaporation gas from flowing from said fuel tank through said upper portion of said space into said carburetor float chamber.

1 Claim, 2 Drawing Figures

CANISTER

This a continuation of application Ser. No. 697,848 filed June 21, 1976 now abandoned

BACKGROUND OF THE INVENTION

The present invention relates to a canister for an internal combustion engine-driven vehicle such as an automobile or the like.

A canister to be generally employed for an internal combustion engine-driven vehicle is a fuel evaporation gas discharge inhibitory apparatus having activated carbon (charcoal) disposed in a container, wherein a fuel evaporation gas generated in a fuel tank and a carburetor is caused to be temporarily absorbed in the activated carbon for storage, and then the fuel evaporation gas is caused to be suctioned into an engine for combustion, after being separated from the activated carbon by the application of a process such as the suction of air into the canister at the proper time for operating the engine, for the purpose of preventing the atmospheric air from being polluted by the fuel evaporation gas diffused into the atmosphere. However, the pressure of the evaporation gas from the fuel tank is generally higher than that of the evaporation gas in the float chamber of a carburetor. Therefore, when the evaporation gas inlet pipe running from the fuel tank and the evaporation gas inlet pipe running from the carburetor are connected with each other, an irregular situation occurs such that the evaporation gas from the float chamber of the carburetor is pushed back into the float chamber by virtue of the pressure of the evaporation gas from the fuel tank.

SUMMARY OF THE INVENTION

It is the object of the invention to provide a canister wherein an evaporation gas from a fuel tank may be checked from flowing into a float chamber of a carburetor.

According to the present invention, there is provided a canister comprising: a main body having a space therein; an adsorbent material contained in the space of said main body; an inlet pipe attached to said main body for connecting a carburetor float chamber with an upper portion of said space defined between said main body and said adsorbent material; an air suction pipe attached to said main body through which air suction pipe a lower portion of said space defined between said canister and said adsorbent material communicates with the atmosphere; and valve means for selectively connecting said upper portion of said space with a fuel tank, thereby to prevent an evaporation gas from flowing from said fuel tank through said upper portion of said space into said carburetor float chamber.

In a preferred embodiment of the present invention, a fuel evaporation gas is led from the fuel tank into activated carbon in the canister. A partition is formed vertically in the lower extended section of a valve case fixed in place on the cover of the canister as much as to a certain depth of the layer of the activated carbon in the canister.

DETAILED DESCRIPTION OF PREFERRED EMBODIMENT

Figure 1:
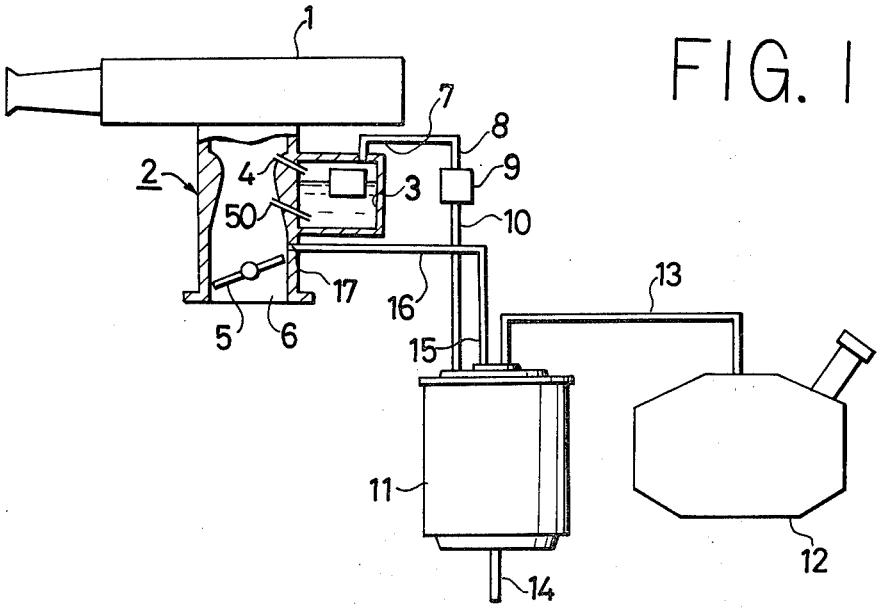
FIG. 1 is a schematic elevational view, partly in cross-section, of a fuel evaporation gas inhibitory system for an automobile wherein there is provided a canister according to an embodiment of the present invention.

FIG. 1 shows the arrangement of a fuel evaporation gas inhibition system wherein the canister according to the present invention is arranged in place on an automobile. Fresh air fed from an air cleaner 1 is mixed with a fuel led through a main nozzle 50 of a float chamber 3 of a carburetor 2, to thus be made into a mixed gas, which has the quantity thereof properly checked by a throttle valve 5, and is suctioned into an engine (not shown) from a suction pipe 6. When the engine is stopped, a fuel evaporation gas is led into a canister 11 from an outer vent 7 arranged in the float chamber 3 by way of a conduit 8, an electromagnetic valve 9, and a conduit 10. Besides, a fuel evaporation gas is led into the canister 11 from a fuel tank 12 by way of a conduit 13. Such a fuel evaporation gas as is adsorbed by an adsorbent 24 (FIG. 2) in the canister 11 is separated from the adsorbent 24 by virtue of fresh air suctioned through a fresh air suction inlet pipe 14 at an appropriate time and led to a purge port 17 opening into the suction pipe 6 by way of an outlet pipe 15 and a conduit 16, then is suctioned into the engine.

Figure 2:
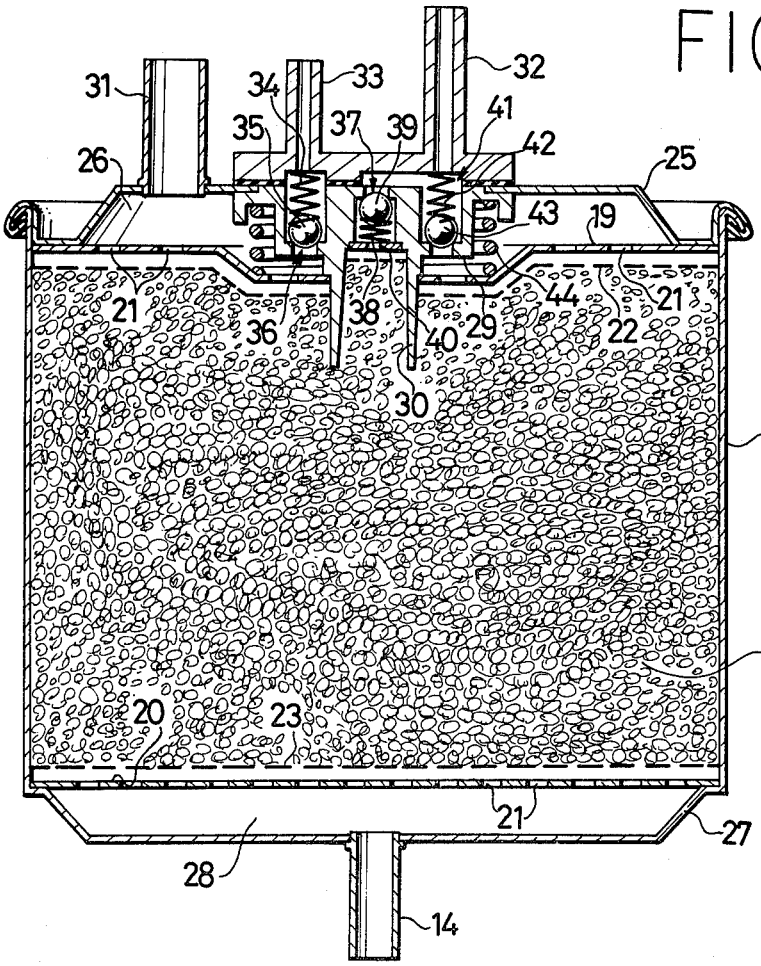
FIG. 2 is a elevational section of the canister shown in FIG. 1.

FIG. 2 is a sectional view of the canister 11 shown in FIG. 1. The interior of the main body 18 of the canister 11 has an upper press plate 19 set in place in the upper section thereof, and a lower press plate 20 set in place in the lower section thereof, with a plurality of apertures 21 formed therein, respectively. An upper filter 22 and a lower filter 23 are set in place slightly lower than the upper press plate 19 and slightly above the said lower press plate 20, respectively. The space formed between the two filters 22, 23 is filled with a layer of activated carbon 24 in a tight manner, which is shown in a simplified mode. An upper space 26 is formed between the upper surface of the upper press plate 19 and a canister cover 25. A lower space 28 is formed between the lower surface of the lower press plate 20 and the bottom section 27 of the main body of the canister, respectively. A valve case 29 is fixed in place such that it penetrates through the canister cover 25. The lower extended section of the valve case 29 has a partition 30 that passes through the upper press plate 19 and the upper filter 22 and is arranged vertically in place. A fuel evaporation gas inlet pipe 31 running from the conduit 10 connected with the float chamber 3 is fixed in place on a part of the canister cover 25. The valve case 29 is provided with a fuel evaporation gas inlet pipe 32 running from the conduit 13 connected with the fuel tank 12, and with an outlet pipe 33 that is connected with the conduit 16 and which is specifically designed so as to cause a fuel evaporation gas adsorbed into a layer of activated carbon 24 to be separated by the suction of fresh air from in the fresh air suction inlet pipe 14 of the canister 11 and to lead the fuel evaporation gas to the purge port 17. A check valve 36 that comprises a return spring 34 and a ball 35 is arranged in place on the outlet pipe 33, whereby the fuel evaporation gas is prevented from flowing back into the canister 11 from the purge port 17. A positive pressure valve 37 connected in a through manner with the inlet pipe 32 running to the canister for a fuel evaporation gas flowing from in the fuel tank 12 in the valve case 29 comprises a return spring 38, a ball 39 and an opening 40. The opening 40 of the positive pressure valve 37 is arranged in place in such a manner as to be in opposition with the interior of a cylinder constituting the partition 30 which has a cylindrical shape whereby the bottom section is kept open. And, in case the pressure in the fuel tank 12 becomes negative, a gas in the canister 11 flows into the fuel tank 12 by way of a negative pressure valve 41 arranged in place in the valve case 29. The negative pressure valve 41 comprises a return spring 42, a ball 43 and an opening. Besides, a spring 44 is arranged in place in a tensile manner between the upper press plate 19 and the valve case 29 for the purpose of pressing the upper press plate 19 downward to thus keep activated carbon free from being subjected to vibration.

In operation, a fuel evaporation gas led into the canister 11 from the fuel tank 12, is led into the activated carbon 24 in the cylindrical partition 30 from the inlet pipe 32 of the valve case 29 by way of the positive pressure valve 37, and is adsorbed into the activated carbon filling the interior space of the canister 11. The fuel evaporation gas adsorbed into the activated carbon is separated from the activated carbon by the application of such a process as the suction of fresh air into the canister from the inlet pipe 14 at an appropriate time, and is led to the purge port 17 by way of the check valve 36 and the outlet pipe 33. The pressure of the fuel evaporation gas led into the canister 11 from the fuel tank 12 is higher than the pressure of the fuel evaporation gas led into the canister 11 from the float chamber of the carburetor. However, the fuel evaporation gas flowing from fuel tank 12 penetrates into the layer of the activated carbon in the cylindrical partition 30, and further penetrates in a diffusive manner into the layer of the activated carbon filling the whole space in the canister. Therefore, the fuel evaporation gas comes in direct contact with such a fuel evaporation gas as is led into the canister 11 from the float chamber 3 of the carburetor, whereby the fuel evaporation gas flowing from in the fuel tank 12 is properly kept free from being pushed back into the float chamber 3.

What is claimed is:

1. A canister for an internal combustion engine having a carburetor that includes a float chamber (3) and a purge port (17) positioned adjacent a throttle valve (5) and a fuel tank (12), said canister comprising:

a hollow, main body (18) having a space therein;

an adsorbent material (24) partially filling said space in said main body and defining upper and lower spaces (26 and 28, respectively) in combination with said main body;

a first inlet pipe (31) attached to said main body (18) for permitting passage of fuel evaporation gases from the float chamber (3) of the carburetor (2) to said upper space (26);

an air suction pipe (14) attached to said main body (18) whereby said lower space (28) communicates with the atmosphere through said suction pipe; and valve means (37, 41 and 36) separate from said first inlet pipe (31) for providing selected fluid communication between both the fuel tank (12) and said upper space as well as the purge port (17) and said upper space, said valve means comprising;

a valve casing (29) positioned in said housing and having a tubular partition (30) extending downwardly therefrom into said adsorbent material (24);

a first, positive pressure ball-type check valve (37) in said valve casing and in fluid communication with said upper space (26);

a second inlet pipe (32) fluidly connecting the fuel tank (12) to said first check valve (37) and to said upper space (26);

a second, negative pressure ball-type check valve (41) in said valve casing and in fluid communication with said upper space (26);

said second inlet pipe (32) also providing fluid communication between said second check valve (41) and the fuel tank (12), said second check valve (41) acting only when the pressure in the fuel tank (12) is negative;

a third ball-type check valve (36) in said valve casing and in fluid communication with said upper space (26);

an outlet pipe (33) fluidly coupling the purge port (17) and said third check valve (36) for preventing the fuel evaporation gas from flowing back from the carburetor (2) into said upper space (26).

* * * * *